United States Patent [19]

Beaudoin

[11] 4,250,609

[45] Feb. 17, 1981

[54] FLUE STACK MAINTENANCE SYSTEM UTILIZING REPLACEABLE LINERS

[76] Inventor: Jimmy A. Beaudoin, 7019 Crowder Blvd. Apt. 140, New Orleans, La. 70126

[21] Appl. No.: 82,287

[22] Filed: Jul. 31, 1979

[51] Int. Cl.[3] ..... B23P 17/00; F23J 11/00; F24C 15/14

[52] U.S. Cl. ..... 29/421 R; 126/280; 126/307 R; 29/402.03; 29/402.09; 29/402.19; 29/507; 138/DIG. 10; 138/139; 138/93

[58] Field of Search ..... 126/307 R, 307 A, 312, 126/280; 138/93, 89.1, 98, DIG. 10, 97; 29/421, 507, 402.03, 402.05, 402.08, 402.09, 402.19

[56] References Cited

U.S. PATENT DOCUMENTS

| | | | |
|---|---|---|---|
| 1,860,855 | 5/1932 | Gardner | 138/93 |
| 2,809,664 | 10/1957 | Vollmar, Jr. | 29/421 |
| 2,970,042 | 1/1961 | Lagerwey | 29/421 |
| 3,247,581 | 4/1966 | Pellizzari | 29/421 |
| 4,043,132 | 8/1977 | Zupanick | 138/93 |

FOREIGN PATENT DOCUMENTS

| | | | |
|---|---|---|---|
| 173348 | 7/1906 | Fed. Rep. of Germany | 126/280 |

*Primary Examiner*—Leon Gilden
*Assistant Examiner*—V. K. Rising
*Attorney, Agent, or Firm*—C. Emmett Pugh & Associates

[57] ABSTRACT

A flue stack maintenance system particularly for those flues through which grease laden air passes such as for example exist in commercial restaurant kitchens and the like (FIG. 1), which utilizes an expandible, elongated metal foil liner bag which forms a closed interior system except for an air inlet conduit provided for the application into the interior of the bag an air pressure greater than the ambient to balloon out the bag into facing engagement with the interior of the flue stack (FIG. 3B). After the bag is ballooned out, the upper and lower ends are opened and folded over and around the ends of the flue for attaching the foil liner to the flue (FIG. 3C). After the liner becomes laden with deposits of grease and the like, it is removed by sealing off the distal end and closing off the proximate end around a vacuum hose which applies to the interior of the liner a negative or vacuuming pressure below the ambient, which causes the liner to collapse inwardly for its easy removal from the flue stack (FIGS. 4A and 4B) to be replaced with a new liner bag. The liner bag is made from for example an aluminum foil sheet folded over in half unto itself and sealed along its mating edges with the air inlet conduit extending through one edge (FIGS. 2A and 2B). Longitudinal and lateral expansion folds can be included in the bag structure, exemplary folds being accordian type (FIGS. 6 and 7) and Z-Type folds (FIGS. 5 and 8). A liner bag having two separable liner walls allowing for separate removing of the inner liner leaving the outer liner with the flue is also disclosed (FIG. 9).

16 Claims, 13 Drawing Figures

FLUE STACK MAINTENANCE SYSTEM UTILIZING REPLACEABLE LINERS

BACKGROUND OF THE INVENTION

1. Field of the Invention

The present invention relates to the maintenance of flue stacks and the like to keep them in sufficiently clean condition, particularly those flues through which grease-laden air passes, such as for example those which exist in commercial restaurant kitchens and the like which must be regularly cleaned of any greasy deposits for sanitary and safety purposes, and more particularly the present invention relates to a maintenance system which includes a replaceable liner which is applied to the flue by means of ballooning air pressure applied to the interior of the liner which is originally inserted in a relative compact disposition.

2. Prior Art

A problem which is of continuous maintenance concern is the maintaining of flues, in for example commercial restaurant kitchens, free of large, greasy deposits which occur on the interior of the flue, and if allowed to build up too much, can cause sanitary problems and also safety problems because of the inherent fire hazard involved.

Heretofore, it has been necessary to have the interior wall surfaces of such flues maintained by the commercial establishment's staff or by an outside cleaning service, who, after dismantling the entry and exit portions of the flue stack, clean the interior surfaces in a scrubbing process utilizing appropriate chemical, detergent agents. This process of course is quite dirty, time consuming and relatively expensive and also produces considerable down-time of the cooking facilities associated with the flue stack.

Likewise in the home such prior art cleaning techniques usually required employing expensive sweeps, hours of inconvenience, and damage to furniture, carpets and walls due to the soot settling during cleaning.

The present invention is directed to overcoming and resolving these prior art problems with an efficient, quickly applied, reliable and relatively inexpensive system which produces relatively no mess or fuss in comparison to the techniques of the prior art.

A tabular listing of prior U.S. patents known to applicant which may be of interest to the present invention is presented below:

| Inventor(s) | Patent No. | Issue Date |
|---|---|---|
| A. C. Badger | 895,412 | August 11, 1908 |
| Pierre Thivans | 3,897,619 | August 5, 1975 |
| H. V. Ludwick | 2,086,134 | July 6, 1937 |
| R. R. Pierce Et al | 3,367,075 | Feb. 6, 1968 |
| John R. Roy | 3,537,411 | Nov. 3, 1970 |

It is noted that the Badger patent discloses the use of very high internal air pressure (100 lbs./sq. in.) in applying and bonding in association with heat a layer of lead or zinc through two solder coatings to the interior of a steel cylindrical receptacle.

The Thivans patent discloses the use of fluid pressure for placing a connecting sleeve between two pipe sections.

The Ludwick patent discloses a method of making a tank for a tank truck in which interior hydraulic pressure is used to cause flat metal sheets to conform to the interior cylindrical surface of the tank which sheets are then held in place with reinforcing bands.

The Pierce et al. patent discloses the use of a fluorocarbon plastic membrane which is applied in sheet form like a bandage to a chimney wall to serve as a corrosion proof liner.

The Roy patent discloses the use of a double shelled chimney stack made up of a load bearing outer metal shell and a non-load bearing inner metal shell with a sealed, insulating annular air space between them.

However, it is believed clear that none of these prior patents singly or in combination fairly teach or suggest the present invention.

SUMMARY DISCUSSION OF PRESENT INVENTION

The present invention utilizes a replaceable liner system which at regular or on an "as needed" basis is removed and replaced with a new lining.

The liner can be pre-manufactured in a closed, "bag" form in a "collapsed" or compact disposition which is thereafter inserted into the interior of the flue stack and on-site is expanded and ballooned out by means of applying a air pressure into the interior of the bag at a level higher than that of the ambient. After being ballooned out so that the exterior surface of the bag liner is in face-to-face engagement with the interior of the flue stack along its length, the ends of the ballooned bag are then opened and folded over and around the terminal edges or ends of the flue stack to thereby attach the liner to the flue stack during use. Any grease or other deposits being carried by the air through the flue stack is then deposited on the liner rather than on the interior surface of the flue stack itself.

When it is time for "cleaning" the flue stack, the distal end of the liner is then folded back and sealed closed with the proximate end then folded inwardly around preferably the intake hose of for example a vacuum cleaner to thereby apply a negative air pressure less than the ambient, that is, a vacuuming, suction pressure, in the interior of the liner, causing it to be collapsed and sucked inwardly. The liner can then easily be moved out of the stack in the longitudinal direction, with all of the greasy and other foreign matter deposits being totally contained and trapped within the collapsed or sucked in bag for disposal.

A new liner can then be applied to the interior of the flue using a new liner bag and repeating the foregoing application process.

Thus it can be seen that the mess and trouble of the prior art are avoided in a most efficient and expeditious manner.

The bags can be relatively inexpensively manufactured by, for example, merely taking metal foils such as aluminum foil and folding such a sheet over in half onto itself and sealing the peripheral edges to form a closed envelope or bag. As air inlet conduit of, for example, straw-like form can be included in the pre-manufactured bag structure, with the higher air pressure being applied to the interior of the bag for its expansion and ballooning out by the user merely blowing into the air inlet conduit or by using a fan type blower or some compressed gas tank source with appropriate hosing to mate with the air inlet conduit.

Of course such bags can be made in many different sizes for different sized flues, with the bag size having a horizontal, cross-sectional dimension at least as great as and preferably exceeding the horizontal, cross-section of the flue and having a longitudinal length in excess of the total length of the flue to be lined.

In addition to being premanufactured in gross quantities at a factory location, the bags of course could be prepared and assembled on site at the flue location with the metal foil being provided in rolls to be made up to appropriate lengths and diameters.

Thus, as it can be seen, the system of the present invention is quite flexible and lends itself to great ease in application and manufacture in a reliable and efficient manner.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein:

FIG. 2A is a plan view of a preferred exemplary embodiment of the liner bag of the system of the present invention; while

DETAILED DESCRIPTION OF THE PREFERRED EMBODIMENTS

As mentioned in the foregoing, it is necessary for sanitary and safety reasons to maintain flue stacks in a relatively clean condition, particularly in flue stacks associated with commercial restaurant kitchens in which a relatively large amount of air laden with grease and other deposits pass through the flue stack, ultimately forming unsanitary and unsafe, substantial deposits of grease and other foreign matter on the interior walls of the flue.

Figure 1:
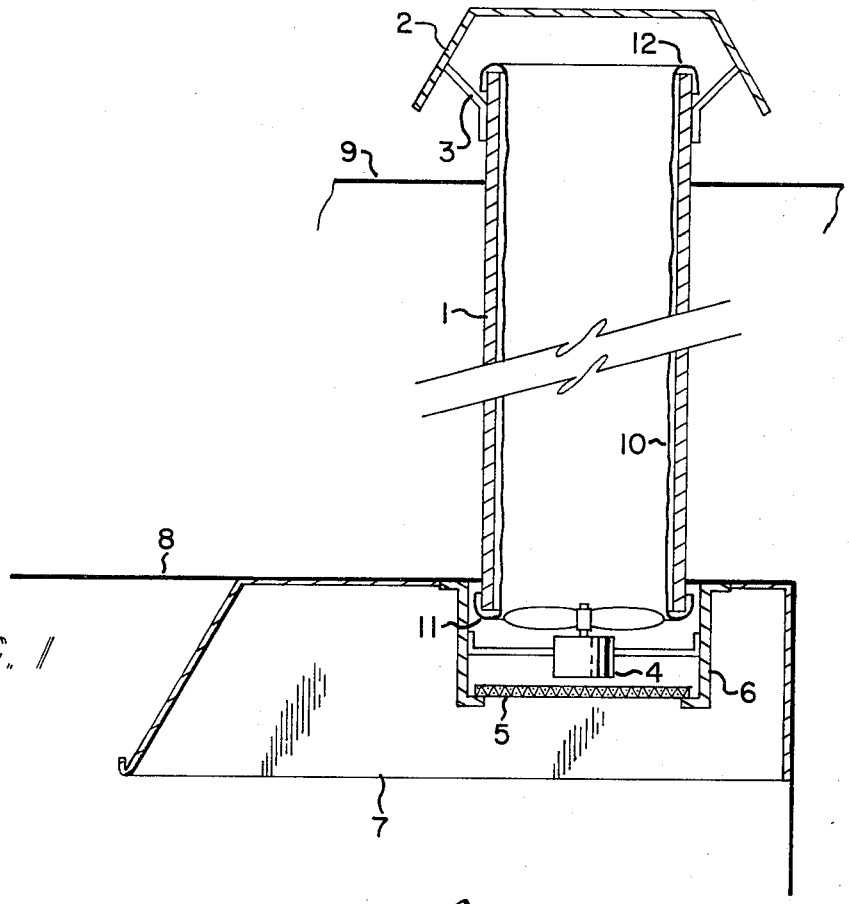
FIG. 1 is a side, cross-sectional view illustrating an exemplary application for the preferred embodiment of the lining system of the present invention.

Such an exemplary application is illustrated in a generalized, simplified form in FIG. 1. As illustrated in FIG. 1, such an exemplary flue stack 1 usually has associated with it a flue cap 2 to prevent rain and the like from entering into the flue or stack 1, which flue cap 2 is attached to the top of the flue stack 1 by means of mounting assembly arms 3. The lower end of the flue stack also often includes an exhaust fan 4 and filter 5 which is mounted by means of the housing 6 to a vent hood 7, attached to and supported by an appropriate part of the building structure, such as for example, the ceiling 8 and adjacent wall 8'. The flue typically extends through the upper portion of the building structure through the roof 9 to the exterior of the building. Of course, many flue stacks have curved or bent portions in them and, rather than extending vertically through the roof 9, will be vented out through a side wall of the building; and the particulars of the flue stack system illustrated in FIG. 1 is merely intended to be for illustrative purposes only.

As shown in FIG. 1, the preferred embodiment of the liner 10 ultimately is applied to the interior surface of the flue stack 1, with the exterior surface of the liner 10 in face-to-face engagement with the interior surface of the flue stack 1 preferably throughout substantially all of its longitudinal length. The liner 10 terminates in its lower endings 11 and its upper endings 12, both of which are folded over and around the terminal edges or ends of the flue stack 1 for securing the liner 10 to the flue stack. During use of the liner of the system of the present invention, exhaust fan 4 will pull the fumes and air collected by the vent hood 7 through the filter 5 and then blow them up through the flue stack 1 to the exterior environment or ambient, with the veno hood 7 usually located over a stove or other cooking surface. Although the filter 5 will initially take out much of the foreign matter and a lot of the grease which is carried up with the air, substantial portions of grease and other foreign contaminants are brought up into the flue stack 1, most of which is then deposited on the interior surface of the liner 10 or, in the absence of such a liner, directly on the interior surface of the flue stack 1.

Of course when it is desired to initially apply or replace the liner 10 on the flue stack 1, it will usually be necessary to remove the lower flue system elements, namely housing 6 with the exhaust fan 4 and the filter 5, and the upper elements of the flue system, namely flue cap 2 and mounting assembly arms 3, in order to allow free and easy access to the interior of the flue stack 1, and then to reassemble these elements onto the flue stack 1 after the liner application has been completed. This is of course also necessary with the standard, prior art techniques of cleaning the interior of the flue stack by means of scrubbing with chemicals and detergents.

Figure 2A:
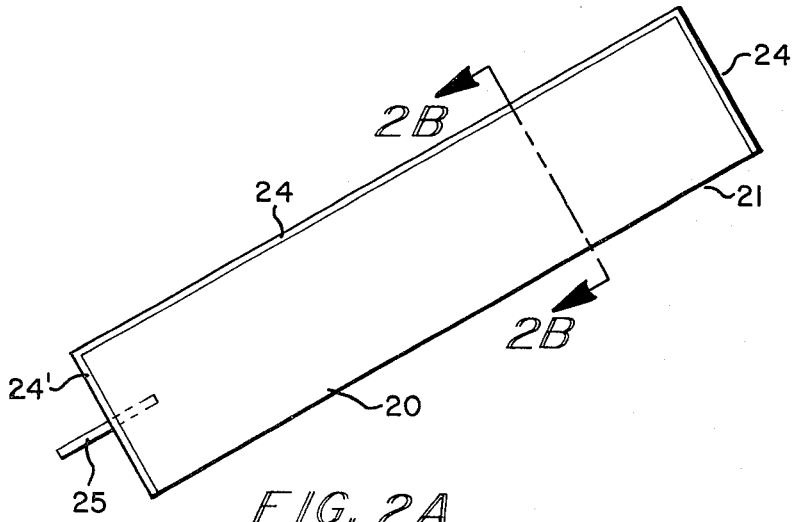
Figure 2B:
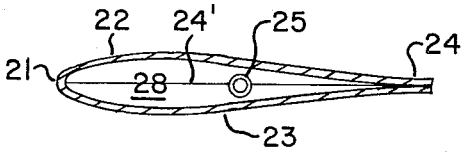
FIG. 2B is a side, cross-sectional view of the bag liner embodiment of FIG. 2B, taken along the section lines 2B—2B of FIG. 2A.

In the preferred embodiment of the system of the present invention, the liner is initially provided or supplied in the form of a closed, sealed, expandible, elongated bag 20, as illustrated in FIGS. 2A and 2B. For example, as best illustrated in FIG. 2B, the bag liner 20 can be made from a sheet of for example aluminum foil folded over onto itself about the fold line 21 forming an upper wall 22 and a lower wall 23. The walls 22, 23 are sealed together along their peripheral edges 24 by gluing, heating, folding, or other joint forming means, or other appropriate bonding means, to form a completely, sealed and enclosed interior 28, except for the presence of air inlet conduit 25 which extends through one of the sealed edges 24'. Of course, if it is desired to make the initial configuration of the bag liner 20 even more compact, the bag structure itself can be further folded onto itself in order to shorten its lateral dimension for easy insertion of the bag in its "collapsed" or folded, compact disposition into a flue for application purposes.

Although the bag liner 20 can be made of many different materials, it is preferably made of a flexible sheet of metal and an exemplary material is aluminum foil, for example of the type used to wrap food and the like. Also, the particular configuration and disposition of the bag liner of the present invention is subject to great variation, and indeed several different embodiments will be disclosed herein for exemplary purposes. The main requirements for the liner bag is that it can be inserted longitudinally within the flue stack, preferably extending end to end and be expandible out in face-to-face engagement out against preferably substantially all of the longitudinal length and also preferably about the lateral extent of the interior surface of the flue stack, with some means being provided to attach the expanded liner so that it remains in the flue stack during use.

Figure 3A:
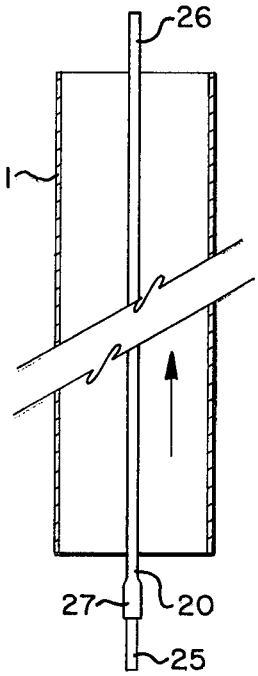
FIGS. 3A, 3B and 3C are side, simplified views of a flue stack (with FIG. 3A being a cross-sectional view) showing the basic steps in the preferred embodiment of the applying method of the system of the present invention.
Figure 3B:
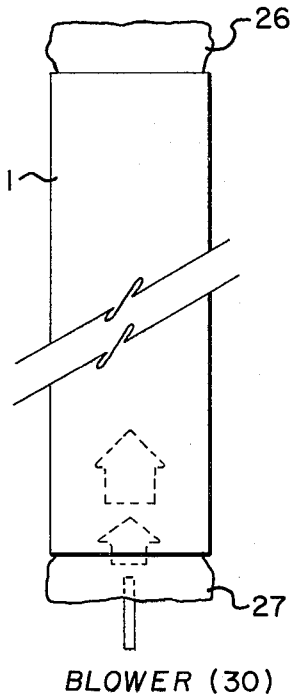
Figure 3C:
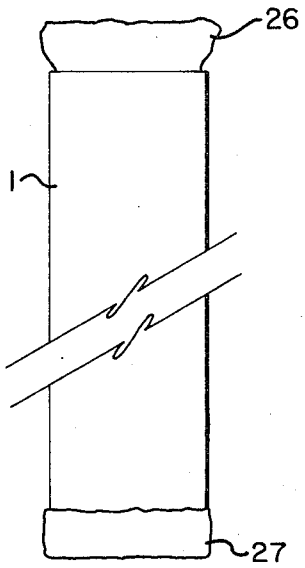

The preferred method of applying the liner to the flue stack 1 with the use of the bag liner 20 is illustrated in sequential steps in FIGS. 3A–3C.

After the bag liner 20 has been appropriately made up and formed either at the factory or on-site, the bag liner in its compact or "collapsed" configuration is longitudinally inserted (note directional arrow) through the flue stack and preferably centrally positioned therein with its distal end 26 and its proximal end 27 extending out past the terminal ends of the flue stack liner 1, all as generally illustrated in FIG. 3A. After being so appropriately positioned within the flue stack 1, air pressure is applied to the closed interior envelope formed by the bag liner 20 by means of the air pressure inlet conduit 25, causing the bag liner 24 to expand and balloon out against the interior surfaces of the flue stack 1 in face-to-face engagement therewith, with the end portions 26, 27 of the bag liner extending out past the ends of the stack 1, all as generally illustrated in FIG. 3B. The air pressure being applied to the interior of the bag in this step is supplied by means of a blower 30 which can be merely the blowing pressure of the user blowing through the straw-like conduit 25 or other mechanical means can be used to produce a ballooning air pressure in the interior of the bag liner 20 which is greater than that of the ambient. Other suitable sources for the air pressure could be for example, hand pumps, foot pumps, fan blowers, compressed gas tanks, etc. It should be further understood that in using the phrase "air pressure" no particular gaseous fluid is intended although the ambient air can of course be used and it is obviously readily available without cost.

As illustrated, the bag 20 is initially inserted in a flat, compact disposition into a cylindrically shaped flue 1. However, whether the flue is round or square or whether the bag is initially round or flat generally makes no difference because the pressure of the air will cause the flexible foil material to assume in either case the interior shape of the flue.

After the bag has been inflated out against the interior surfaces of the flue stack 1, the air inlet conduit 25 is removed from the proximal end portion 27, which is then unsealed and opened up and folded around and about the exterior end surface of the flue stack 1, as generally illustrated in FIG. 3C, so as to attach the liner 20 to the flue stack 1. Of course the liner 20 could otherwise be secured to be held in place so that it itself will not be blown through the flue stack during use of the flue exhaust system after application of the liner. Thus, for example, if the exterior surface of the flue stack 1 is not readily available for having the end portions 27 folded over them for attachment, the end portions 27 could be merely laterally flared out and secured to the undersurface of the wall or other structure from which the flue stack extends upwardly. The end portions 27 can be secured by adhesive, tape or other means if desired, or merely just mechanically held in place by means of the folds as illustrated in FIGS. 1 and 3C. Also, preferably, the distal end portions 26 of the bag liner 20 are also opened up and folded over and around the end of the flue stack 1, if such exterior surface is available, or is otherwise preferably secured at the upper end. However, although such upper connection or attachment is preferred, it is possible to get by with only a lower attachment which would then serve to restrain the liner 20 from being blown up through the flue stack 1.

Figure 4A:
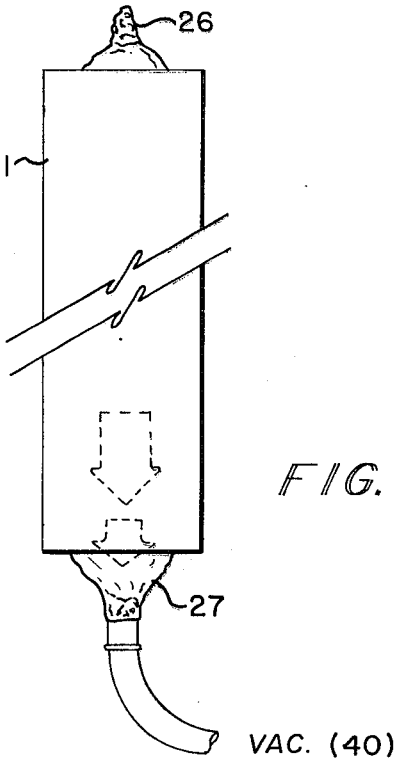
FIGS. 4A and 4B are side, simplified views, similar in perspective to FIG. 3A through FIG. 3C, except showing the basic steps in the preferred liner removal method of the system of the present invention.
Figure 4B:
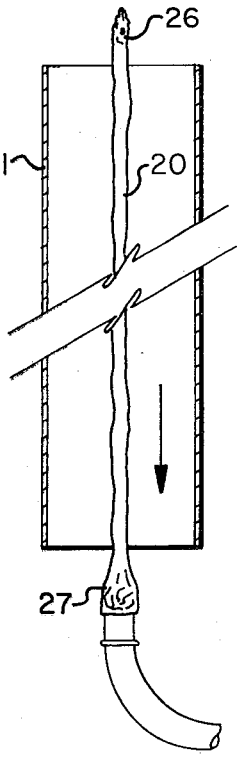

An exemplary, optional but preferred method for removing the stack liner 20 from the flue stack 1 is illustrated sequentially in FIGS. 4A and 4B. The distal end portions 26 of the liner 20 are unattached from the flue stack system and sealingly closed off by twisting or otherwise, closing off the theretofore open upper end of the liner 20, as generally illustrated in the upper part of FIG. 4A. The lower, proximal end portions of the liner 20 are also disconnected or unattached from the flue stack system and drawn inwardly in closed, sealing engagement with the hose 41 of a vacuum or negative air pressure source 40, which can be the standard hose of a typical home-type vacuum cleaner. The negative air-pressure which is thereby applied to the interior of the liner 20 causes the liner 20 to collapse and be sucked inwardly toward the longitudinal, center line of the flue stack 1. The liner 20 then takes the form of a generally circular, truly collapsed, sucked in configuration as generally illustrated in FIG. 4B, which allows for its easy removal longitudinally downwardly from the flue stack 1 (note directional arrow). By following the foregoing preferred, removal procedure, it is noted that all of the greasy deposits and other foreign deposits which have accumulated on the interior surface of the liner 20 are sealed in to the collapsed interior of the bag liner 20, avoiding any contamination and fall-out down into the cooking surface or other area which may be located below the flue stack 1, as would normally occur in the scrubbing process of the prior art.

Such a procedure with such a collapsed, relatively small "bag liner" 20 allows for easy and compact disposal of the used liner and its deposits and contaminants.

As mentioned above, many variations of the bag liner structure and configuration are possible and exemplary ones are illustrated in FIGS. 5 through 9.

Figure 5:
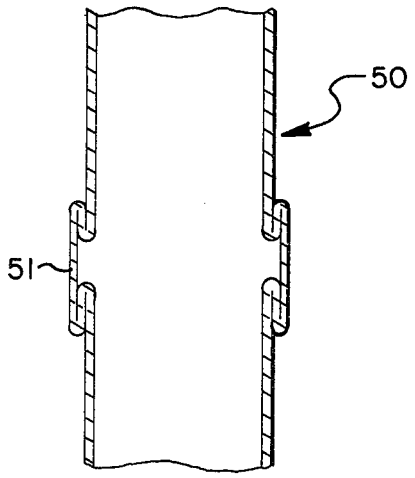
FIGS. 5 and 6 are side, cross-sectional views of two additional embodiments of the bag liner of the system of the present invention, illustrating two exemplary folds which allow for expansion in length as needed for the liner to be applied to a flue having a bend or turn in it.
Figure 6:
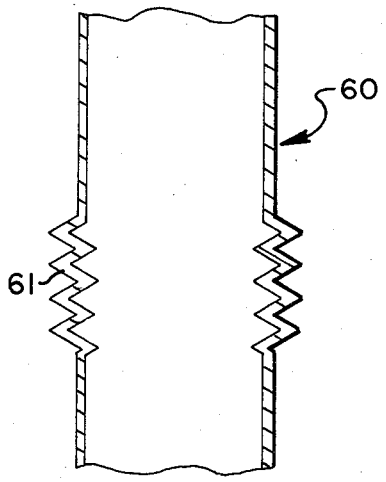

FIGS. 5 and 6 illustrate two bag liners, 50, 60, respectively, having laterally disposed expansion folds 51, 61, respectively, which allow for easy longitudinal expansion where needed as, for example, may occur when the flue stack has a bend, turn or curve in it. Such a deviation causes the longitudinal extent of the bag liner portion on the upper side of the curve to be greater then the total longitudinal extent of the lower side of the curve. The exemplary fold of FIG. 5 is a Z-type fold 51 having over-lapping layers which can be longitudinally pulled apart as needed to provide the needed longitudinal length a specific application may require, while the fold embodiment of FIG. 6 is an accordion-type fold 61. Of course a number or series of such expansion folds can be provided at spaced locations along the longitudinal length of the bag liner and can be used to handle not only the difference in the longitudinal length produced by curved or bent flue stack but also for providing a single, "standard" bag liner for use with flue stacks of many different, varying lengths, so that, if the bag liners are premanufactured at a factory, stocking or inventory requirements can be minimized.

Figure 7:
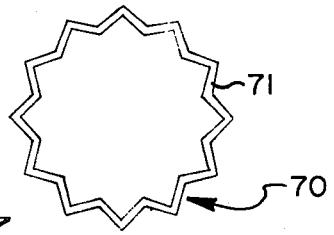
FIGS. 7 and 8 are lateral, cross-sectional views of two further embodiments of the bag liner of the system of the present invention, illustrating two types of longitudinally extending pleats or folds to allow for ease of expansion as the bag liner is ballooned out against the interior of the flue in the application process of the system of the present invention.
Figure 8:
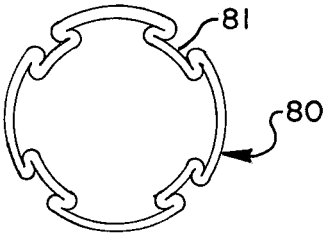

FIGS. 7 and 8 illustrate two further embodiment of bag liners 70, 80, respectively, with these embodiments having a series of longitudinally extending expansion folds 71, 81 respectively, with the expansion fold for bag liner 70 being an accordion-type pleat or fold 71, while the expansion fold of the bag liner 80 of FIG. 8 is a Z-type fold or pleat. The folds or pleats 71, 81 allow not only for ease in expanding the bag liners 70, 80 out to the required diameter of the particular flue stack involved, but also give some longitudinal strength or relative rigidity to the bag liners 70 and 80. This allows them to be longitudinally inserted in similar fashion to that shown in FIG. 3A up or down (as the case may be) a relatively long flue stack without the bag liner in its compact disposition falling about or down upon itself when being inserted upwardly. Of course, it is also possible to include within the same embodiment both lateral as well as longitudinally extending expansion folds.

Figure 9:
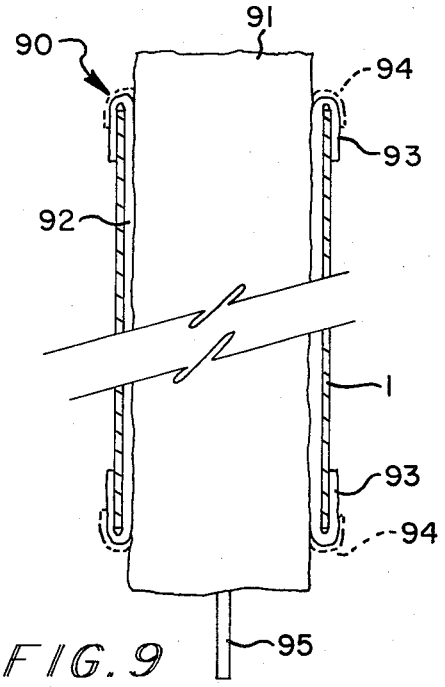
FIG. 9 is a side, cross-sectional view of a multiple-layer, further embodiment of the bag liner of the system of the present invention, which includes separable liners allowing for removal of an interior liner after use, while leaving the outer liner on the flue.

A final, further illustrative embodiment of a bag liner 90 is shown in FIG. 9, which embodiment includes two (as illustrated, or more) separable liners, 91 and 92, an inner liner 91 and an outer separable liner 92. FIG. 9 illustrates bag liner 90 in its almost completed application disposition. The initial bag liner 90 is provided with the two bags 91 and 92, with bag liner 92 covering and enclosing bag liner 91, with both being expanded or ballooned out together at the same time, and with each then being secured to the flue liner 1 either independently or together. The separable bag liners 91, 92 allow for a simultaneous, multiple application of liners, with the inner one 91 being initially and separably removable from the flue stack 1 after use, leaving any others that may have been initially provided, which in the illustrated embodiment of FIG. 9 includes one outer liner 92, in position on the flue stack 1 after liner 91 has been totally removed. As illustrated in FIG. 9, the ends 93 of the liner 92 are longer than the ends 94 of the liner 91 to assist in the easy, separate removal of the liner 91.

The above are of course merely exemplary of the possible changes or variations. Because many varying and different embodiments may be made within the scope of the inventive concept herein taught and because many modifications may be made in the embodiments herein detailed in accordance with the descriptive requirements of the law, it should be understood that the details herein are to be interpreted as illustrative only and not in a limiting sense.

I claim:

1. A method of maintaining the interior wall surfaces of a flue through which for example grease-containing air passes, comprising the following steps:

(a) providing at least one relatively compact, elongated, flexible, expandible liner bag having at least one closed end and having in its expanded disposition a horizontal cross-sectional dimension at least as great as that of the flue;

(b) inserting the bag in its compact disposition into the flue so that its elongated dimension longitudinally extends along the length of the flue;

(c) applying air pressure in excess of the ambient into the interior of the bag and thereby ballooning it out against the interior surfaces of the flue to form a lining of the bag material on said interior surfaces;

(d) opening the closed end of the liner bag;

(e) attaching at least the lower end of the expanded liner bag to keep the liner in position during use; and (f) in due course, when said liner becomes coated, damaged, etc., or when otherwise desired, removing the used liner and replacing it with another by repeating steps "a" through "e" supra with another liner bag; thereby maintaining the interior wall surfaces of the flue from becoming excessively grease coated without the necessity of manual or machine cleaning of said interior wall surfaces.

2. The method of claim 1 wherein step "f" includes the following steps:

(i) closing off at least one end of the ballooned liner; and (ii) applying a negative air pressure less than that of the ambient into the interior of the bag, sucking it in, and thereby causing it to collapse inwardly away from the said interior wall surfaces.

3. The method of claim 1 wherein step "e" is performed by the step of folding the lower end of the expanded bag over and around the end of the flue.

4. The method of claim 3 wherein said folding step is performed at both ends of the expanded bag.

5. The method of claim 1 wherein step "a" includes the step of having a liner bag having two separable walls, and step "f" includes the step of removing only the innermost of the two separable walls, leaving the outermost wall on the flue.

6. A liner for lining the interior surfaces of a flue or the like, comprising an elongated bag of flexible, expandible material closed at least one end and having a lateral, horizontal cross-sectional dimension at least as great as that of the flue, said bag in its initial, compact disposition being easily insertable longitudinally into the flue and having a length greater than the length of the flue and being baloonable out under the application of an interior air pressure greater than the ambient into face-to-face facing engagement with the interior surfaces of the flue along the full length of the flue, the longitudinal end portions of the bag after the closed ends have been opened being foldable up and around the ends of the flue to provide attachment means for attachment of the balooned bag to the flue to serve as a liner for the flue.

7. The liner of claim 6 wherein said bag is completely closed except for an air pressure inlet conduit extending from the interior of the bag to the exterior of the bag, said conduit serving as pressure applying means for applying an air pressure greater than the ambient to the interior of the bag to balloon it out.

8. The liner of claim 6 wherein said bag is made of metal foil.

9. The liner of claim 8 wherein the bag is formed of a sheet of metal foil folded over in half onto itself and sealed along its peripheral, contacting edges.

10. The liner of claim 6 wherein said bag includes about its lateral periphery at least one laterally extending, expandible fold, said laterally expanding fold forming longitudinal expansion means for allowing said bag to be longitudinally extended at selected portions of said lateral periphery to match a bend in the flue.

11. The liner of claim 10 wherein said fold is an accordian type fold.

12. The liner of claim 10 wherein said fold is a Z-type fold.

13. The liner of claim 1 wherein said bag includes a series of longitudinally extending, expandible folds about its periphery, said longitudinally extending folds forming lateral expansion means for allowing said bag to be laterally expanded out to contact the interior surfaces of the flue.

14. The liner of claim 13 wherein said folds are accordion type folds.

15. The liner of claim 13 wherein folds are Z-type folds.

16. The liner of claim 6 wherein said bag includes at least two separable walls forming two separable inner and outer liners providing means for selectively separate removal of the inner liner from the flue, leaving said outer liner in the flue.

* * * * *